US009028102B2

(12) United States Patent
Li et al.

(10) Patent No.: US 9,028,102 B2
(45) Date of Patent: May 12, 2015

(54) LUMINAIRE HAVING INNER FLOW PATH

(75) Inventors: Po-Wei Li, Taipei (TW); Tsung-Chi Lee, Taipei (TW); Shih-Chang Hsu, Taipei (TW); Chin-Yin Yu, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 410 days.

(21) Appl. No.: 13/296,398

(22) Filed: Nov. 15, 2011

(65) Prior Publication Data

US 2012/0230026 A1 Sep. 13, 2012

(30) Foreign Application Priority Data

Mar. 9, 2011 (CN) ..... 2011 1 0058892

(51) Int. Cl.

| | |
|---|---|
| ***F21V 29/00*** | (2006.01) |
| ***F21K 99/00*** | (2010.01) |
| ***F21V 3/02*** | (2006.01) |
| *F21V 23/00* | (2006.01) |
| *F21Y 101/02* | (2006.01) |

(52) U.S. Cl.

CPC ..... *F21K 9/1355* (2013.01); *F21V 29/2293* (2013.01); *F21V 3/02* (2013.01); *F21V 23/006* (2013.01); *F21Y 2101/02* (2013.01); *F21V 29/77* (2015.01); *F21V 29/83* (2015.01)

(58) Field of Classification Search

CPC ... F21V 29/2293; F21V 29/02; F21V 29/004; F21V 29/2225; F21V 29/2231; F21V 29/2237; F21V 29/2262; F21V 15/011; F21V 29/26

USPC ..... 362/235, 294, 218, 373, 547, 800, 362/249.02; 313/33, 35, 36, 45, 46; 165/128, 80.3, 185; 315/32

See application file for complete search history.

(56) References Cited

U.S. PATENT DOCUMENTS

| | | | | |
|---|---|---|---|---|
| 5,099,399 | A * | 3/1992 | Miller et al. | 362/580 |
| 7,524,089 | B2 * | 4/2009 | Park | 362/294 |
| 7,654,699 | B2 * | 2/2010 | Chang et al. | 362/294 |
| 8,143,769 | B2 * | 3/2012 | Li | 313/46 |
| 8,525,395 | B2 * | 9/2013 | Muessli | 313/46 |
| 8,770,794 | B2 * | 7/2014 | Moeck et al. | 362/249.03 |
| 2010/0073944 | A1 * | 3/2010 | Chen | 362/373 |
| 2010/0187963 | A1 * | 7/2010 | Vaccaro | 313/46 |
| 2011/0089830 | A1 * | 4/2011 | Pickard et al. | 315/32 |
| 2011/0090686 | A1 * | 4/2011 | Pickard | 362/235 |
| 2011/0309735 | A1 * | 12/2011 | Parker et al. | 313/46 |

FOREIGN PATENT DOCUMENTS

| | | | |
|---|---|---|---|
| CN | 101761813 | A | 6/2010 |
| JP | 2004296245 | A * | 10/2004 |

* cited by examiner

*Primary Examiner* — Anh Mai
*Assistant Examiner* — Arman B Fallahkhair
(74) *Attorney, Agent, or Firm* — Rosenberg, Klein & Lee

(57) ABSTRACT

A luminaire includes a base, a light-emitting unit, and a lamp cover. The base includes a first tube part, a second tube part having an inner diameter smaller than that of the first tube part, and a joint part connected between the first and second tube parts. An inner flow path is defined by at least the first tube part, the joint part, and the second tube part in a coaxial manner. The lamp cover is fixed on the base for covering the light-emitting unit. As such, air heated by the light-emitting unit flows out of the inner flow path to thereby allow cold air to be sucked into the inner flow path.

19 Claims, 9 Drawing Sheets

LUMINAIRE HAVING INNER FLOW PATH

CROSS-REFERENCE TO RELATED APPLICATION

This application claims priority of Chinese Application No. 201110058892.7, filed on Mar. 9, 2011.

BACKGROUND OF THE INVENTION

1. Field of the Invention

This invention relates to a luminaire, and more particularly to a luminaire having an inner flow path.

2. Description of the Related Art

Referring to FIG. 1, a conventional luminaire 9 includes a base 90 having a platform, a light-emitting unit 91, a plurality of heat-dissipating fins 92 connected to the light-emitting unit 91, and a lamp cover 93. The light-emitting unit 91 includes a circuit board disposed on the platform, and a plurality of LEDs disposed on the circuit board. Heat generated from the LEDs can be transmitted onto the heat-dissipating fins 92. When the temperatures of the heat-dissipating fins 92 are increased, environmental air is heated to form hot air due to heat exchange. Hence, hot air surrounding the luminaire 9 flows upwardly, and cold air surrounding the luminaire 9 flows downwardly, so that an outer flow field occurs around the luminaire 9.

As such, the heat-dissipating fins 92 are designed solely for increasing heat exchange area, and but not for enhancing airflow occurring during heat exchange. For example, a space defined between any two adjacent heat-dissipating fins 92 is closed at a bottom end of the base 90, so as not to have a sufficient contribution to heat exchange, thereby resulting in a limited cooling efficiency.

SUMMARY OF THE INVENTION

The object of this invention is to provide a luminaire that has an inner flow path arranged to allow air to flow into the luminaire to thereby carry heat away from a light-emitting unit for promoting the cooling efficiency.

Accordingly, a luminaire of this invention includes a base, a light-emitting unit, and a lamp cover.

The base includes a first tube part, a second tube part, a joint part connected between the first and second tube parts, a connector, and an inner flow path that is defined cooperatively by the first tube part, the joint part, and the second tube part in a coaxial manner and that has opposite first and second ends. The connector is disposed at the first end of the inner flow path, and is formed with at least one first aperture.

The light-emitting unit is disposed on the base in such a manner to allow heat generated from the light-emitting unit to be transmitted onto the base.

The lamp cover is fixed on the base for covering the light-emitting unit, and is formed with at least one second aperture.

When a temperature of the base is increased as a result of the heat, heat exchange occurs between the base and air in the inner flow path to form hot air in the inner flow path, so that the hot air flows out of the luminaire through one of the first and second apertures, and cold air is sucked into the luminaire through the other one of the first and second apertures, thereby creating an inner airflow.

Due to formation of the inner airflow and reduction of the inner flow path, the flow rate of the inner airflow is increased to enhance thermal convection.

BRIEF DESCRIPTION OF THE DRAWINGS

These and other features and advantages of this invention will become apparent in the following detailed description of three preferred embodiments of this invention, with reference to the accompanying drawings, in which.

DETAILED DESCRIPTION OF THE PREFERRED EMBODIMENTS

Figure 1:
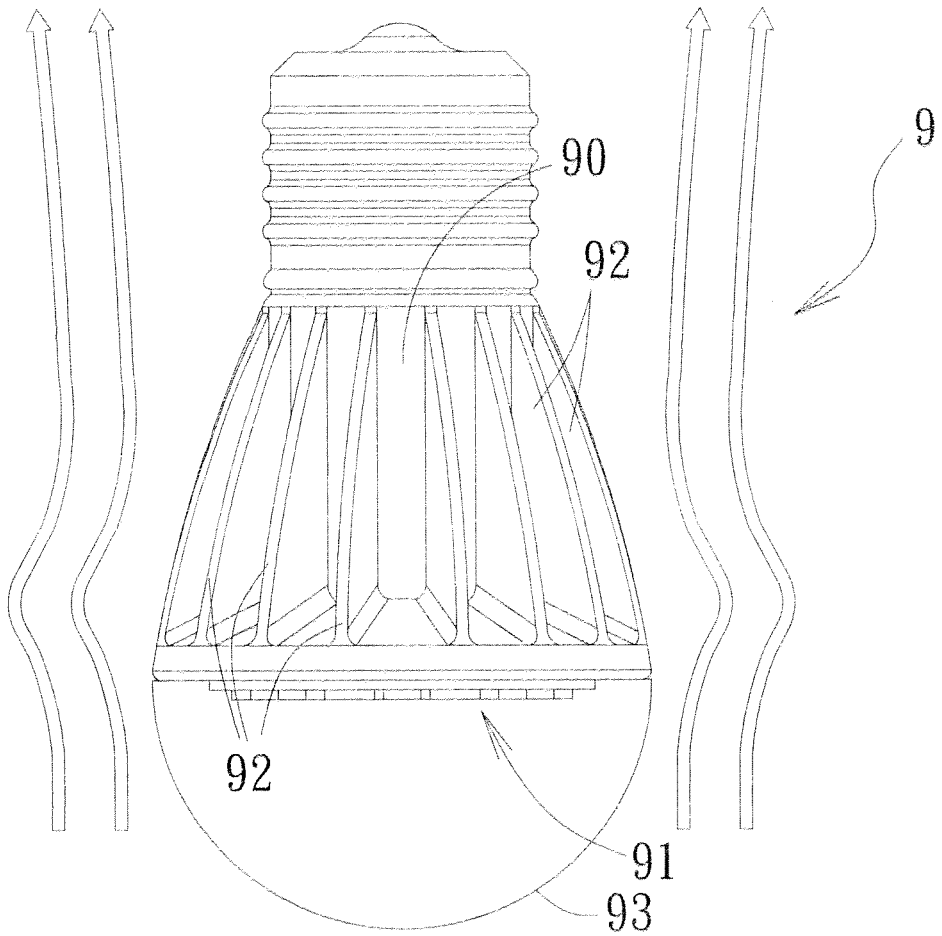
F I G. 1 PRIOR ART
FIG. 1 is a schematic view of a conventional luminaire including a plurality of heat-dissipating fins.

Before the present invention is described in greater detail in connection with the preferred embodiments, it should be noted that similar elements and structures are designated by like reference numerals throughout the entire disclosure.

Figure 2:
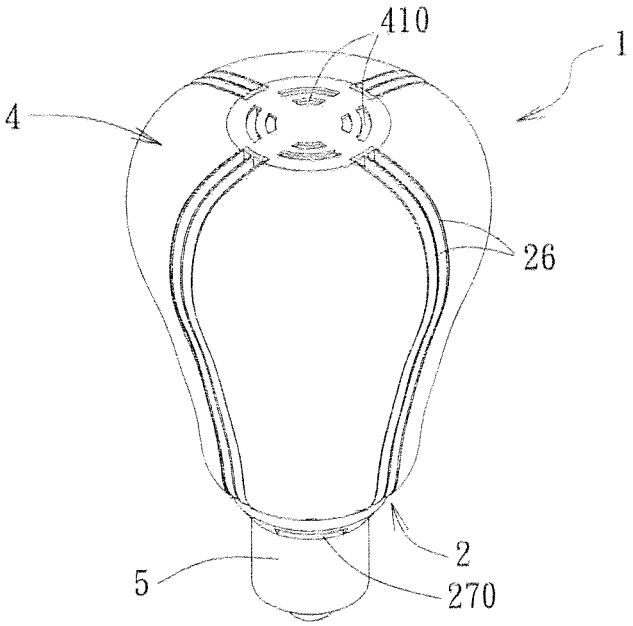
FIG. 2 is an assembled perspective view of the first preferred embodiment of a luminaire according to this invention.
Figure 4:
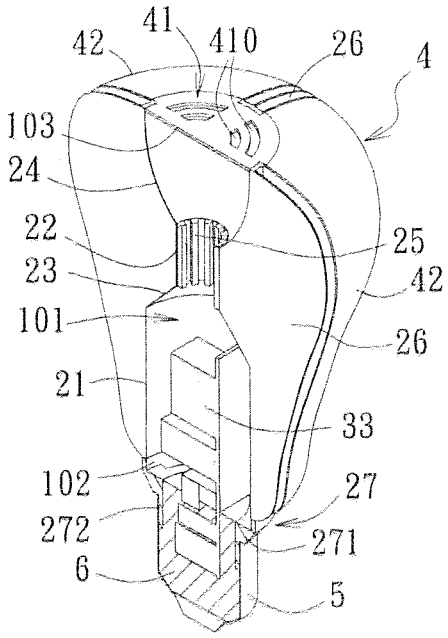
FIG. 4 is a perspective cutaway view of the first preferred embodiment.
Figure 3:
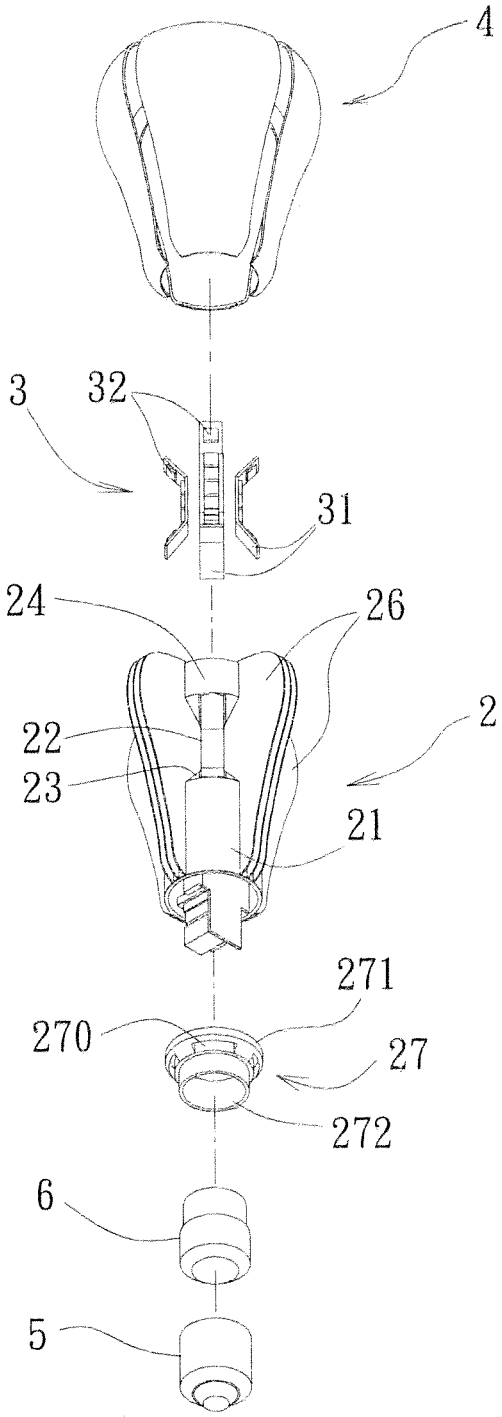
FIG. 3 is an exploded perspective view of the first preferred embodiment.

Referring to FIGS. 2, 3, and 4, the first preferred embodiment of a luminaire 1 according to this invention includes a base 2, a light-emitting unit 3, a lamp cover 4, and a lamp cap 5.

The base 2 includes a first tube part 21 formed from a thermal conducting material by die casting, a second tube part 22 having an inner diameter smaller than that of the first tube part 21, a joint part 23 connected between the first and second tube parts 21, 22, an extending part 24 connected to an end of the second tube part 22 distal from the joint part 23, a plurality of inner fins 25 extending from an inner surface of the second, tube part 22, and a plurality of elongated outer fins 26. The extending part 24 has a connecting end in fluid communication with the second tube part 22, and has an open end that is open toward a distal end of the lamp cover 4 (i.e., an end of the lamp cover 4 distal from the base 2). The extending part 24 has a slope increasing from the connecting end to the open end, so that air can be contracted into the second tube part 22. The outer fins 26 are disposed on the outer surfaces of the extending part 24, the second tube part 22, the joint part 23, and the first tube part 21.

The first tube part 21, the joint part 23, the second tube part 22, and the extending part 24 are coaxial with each other, and define cooperatively an inner flow path 101. The cross-sectional area ratio of the first tube part 21 to the second tube part 22 is greater than 2.25. The joint part 23 is frustoconical and can be a converging tube connected integrally between the first tube part 21 and the second tube part 22. In this embodiment, ratio of the maximum inner diameter to the depth of the extending part 24 is between 1.3 and 1.9. Such a ratio can result in a concentrated and smooth airflow. The functions of the inner flow path 101 and the convergent-divergent structure will be described hereinafter.

In this embodiment, the outer fins 26 are divided into four sets that are radially arranged with respect to the inner flow path 101. Each of the sets includes three outer fins 26. Any two adjacent sets form an angle of about 90 degrees therebetween. Each set of outer fins 26 are parallel to each other. However, the set number of the outer fins 26 and the fin number of each set may be changed according to arrangement of the light-emitting unit 3 without adverse influence on emission of light. Outer sides of the outer fins 26 have a streamline shape to facilitate smooth flow of air therearound to promote the heat-exchanging efficiency.

All of the first tube part 21, the second tube part 22, the joint part 23, the extending part 24, the inner fins 25, and the outer fins 26 are formed as a one-piece member. The base 2 further includes a connector 27 mounted removably to an end of the first tube part 21 distal from the joint part 23 and defining a first end 102 of the inner flow path 101. The connector 27 includes a ring plate 271, plurality of spaced-apart first apertures 270 formed through the ring plate 271, and a first annular wall 272 extending from an inner periphery of the ring plate 271 in a direction away from the first tube part 271. Alternatively, the connector 27 may be connected integrally to the first tube part 21.

The light-emitting unit 3 is disposed on an outer surface of the base 2 such that heat generated from the light-emitting unit 3 can be transmitted onto the base 2. In this embodiment, the light-emitting unit 3 includes a plurality of circuit boards 31 disposed on outer surfaces of the second tube part 22, the joint part 23, and the extending part 24, a plurality of LEDs 32 disposed on the circuit boards 31, and a driver 33 received within the first tube part 21 of the base 2. The driver 33 is electrically connected to the circuit boards 31 and the lamp cap 5. The lamp cap 5 is used to connect with an external power supply. To mount the driver 33, the first annular wall 272 of the connector 27 is sleeved on the lamp cap 5, in such a manner that the lamp cap 5 is disposed, under the connector 27. Next, a portion of the driver 33 is inserted downwardly into the first annular wall 272 of the connector 27, so that it is supported by the lamp cap 5. Afterwards, an insulation paste 6 is poured into spaces among the lamp cap 5, the first annular wall 272 of the connector 27, and the driver 33, so as to protect and fix the driver 33 relative to the lamp cap 5 and the connector 27. Finally, the remaining portion of the driver 33 is inserted into the first tube part 21 until the ring plate 271 comes into contact with the end of the first tube part 21 defining the first end 102 of the inner flow path 101. The first apertures 270 in the connector 27 are not sealed by the insulation paste 6.

Figure 5:
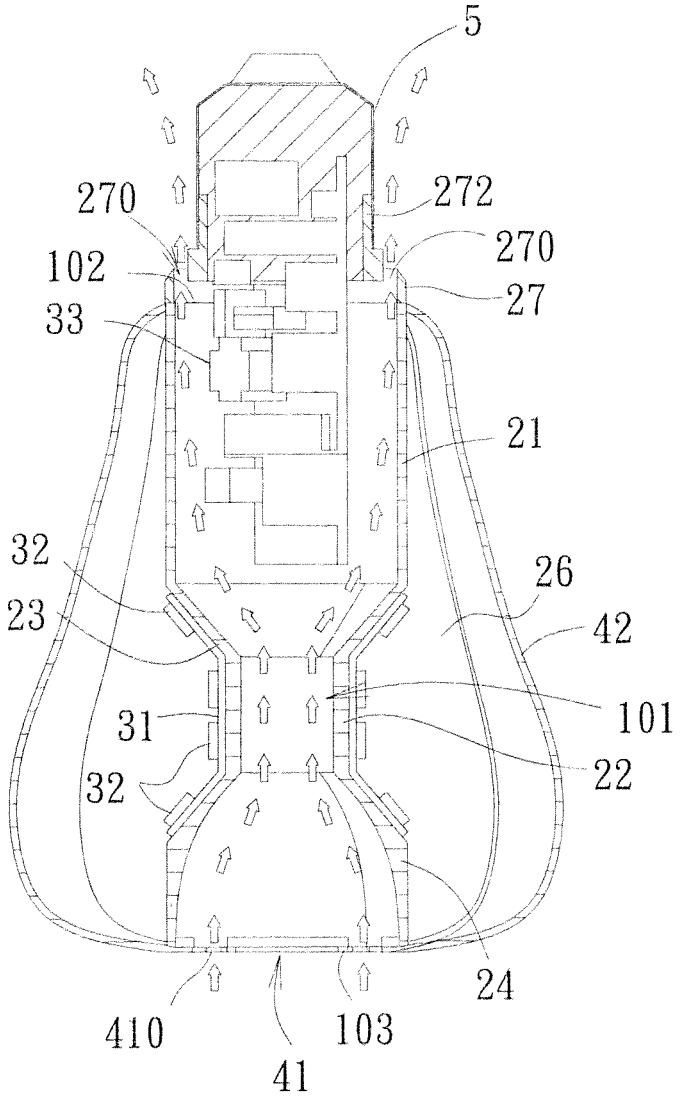
FIG. 5 is a sectional view of the first preferred embodiment, illustrating an inner flow path.
Figure 6:
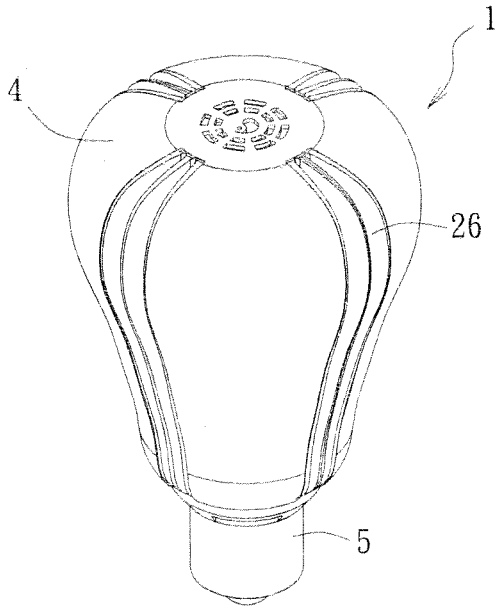
FIG. 6 is an assembled perspective view of the second preferred embodiment of a luminaire according to this invention.
Figure 8:
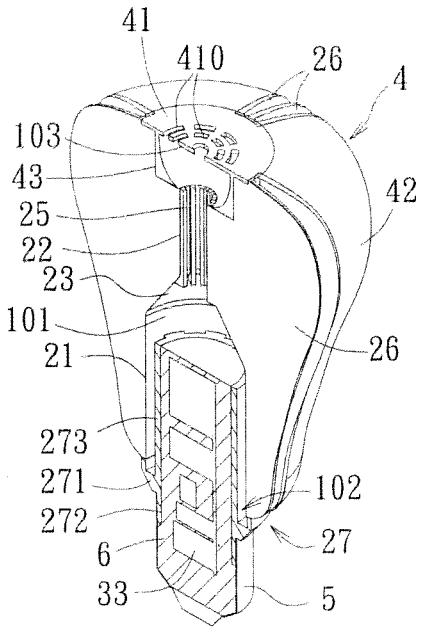
FIG. 8 is a perspective cutaway view of the second preferred embodiment.
Figure 7:
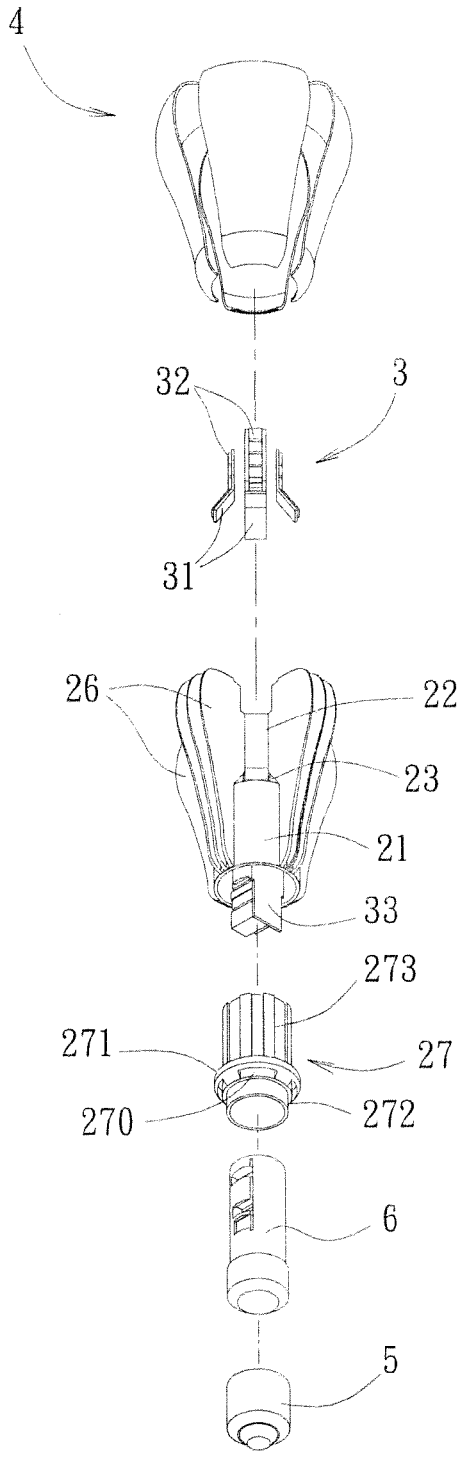
FIG. 7 is an exploded perspective view of the second preferred embodiment.
Figure 9:
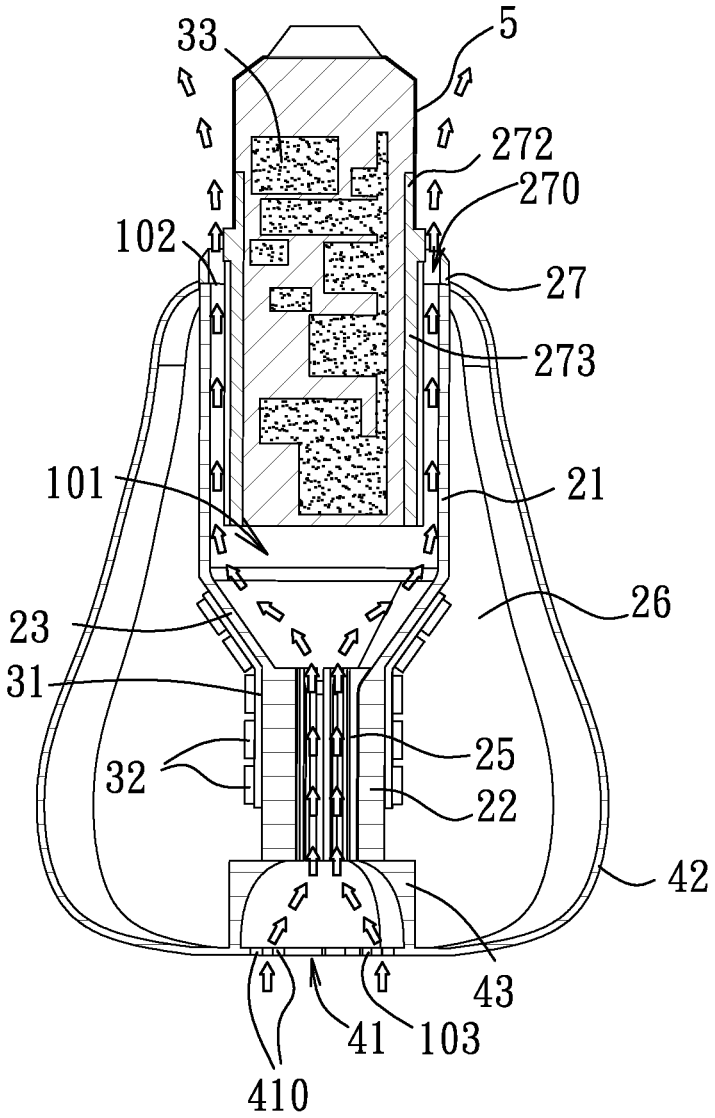
FIG. 9 is a sectional view of the second preferred embodiment, illustrating an inner flow path.

With particular reference to FIGS. 3 and 5, relationships between the positions and light-emitting angles of the LEDs 32 of the light-emitting unit 2 will be described as follows: the LEDs 32 disposed on the circuit boards 31 attached to the outer surfaces of the joint part 23 emit light toward the distal and of the lamp cover 4 due to the frustoconical outer surface of the joint part 23; each of the LEDs 32 disposed on the circuit boards 31 attached to the outer surface of the second tube part 22 emits light in a radial direction of the second tube part 22; and the LEDs 32 disposed on the circuit boards 31 attached to the outer surface of the extending part 24 emit light away from the distal end of the lamp cover 4 due to a curved outer surface of the extending part 24. As such, the view angle of the luminaire 1 is increased, and ranges between 270 and 360 degrees.

The lamp cover 4 covers the light-emitting unit 3, and includes a cover plate 41 for covering the open end of the extending part 24, and a plurality of transparent shade bodies 42 each adhered to two adjacent sets of the outer fins 26. Each of the shade bodies 42 is secured to the cover plate 41 at one end thereof, and to the outer surface of the first tube part 21 or the connector 27 at the other end thereof. The cover plate 41 is formed, with a plurality of second apertures 410. The cover plate 41 and the shade bodies 42 are formed from a transparent material by injection molding or stretch forming.

The function of the inner flow path 101 will now be described. With particular reference to FIGS. 4 and 5, the inner flow path 101 further has a second end 103 opposite to the first end 102. The extending part 24 is connected to the cover plate 41 at the second end 103.

In a situation where the lamp cap 5 is disposed at the upper end of the luminaire 1, the inner flow path 101 is shown by the arrows in FIG. 5. When the LEDs 32 of the light-emitting unit 3 emit light so that heat generated therefrom is transmitted onto the joint part 23, the second tube part 22, the extending part 24 and the inner fins 25 of the base 2 for heat exchange with air therein to form hot air. The hot air flows upwardly out of the luminaire 1 so as to suck cold air into the luminaire 1 to thereby form an inner airflow. The cold air flows into the inner flow path 101 via the second apertures 410 in the cover plate 41 of the lamp cover 4. After passing past the inner fins 25 and the driver 33, the cold air flows out of the luminaire 1 via the first apertures 270 in the ring plate 271 to carry heat away from the LEDs 32 of the light-emitting unit 3 and the driver 33. More importantly, since the cross-sectional area ratio of the first tube part 21 to the second tube part 22 is greater than 2.25 to result in the convergent structure (including the first tube part 21, the joint part 23 and the second tube part 22) of the inner flow path 101, according to the "Bernoulli theorem", the flow rate of the inner airflow within the second tube part 22 is increased to promote the cooling efficiency.

When the luminaire 1 is used in another state where the lamp cap 5 is disposed at the lower end of the luminaire 1, hot air flows upwardly out via the second apertures 410 in the lamp cover 4, and cold air flows into the luminaire 1 via the first apertures 270 in the ring plate 271 of the base 2, subsequently over the driver 33 and the inner fins 25, and out of the luminaire 1 via the second apertures 410.

FIGS. 6, 7, 8, and 9 shows the second preferred embodiment of a luminaire 1 according to this invention. Unlike the previous embodiment, the extending part 24 is omitted from the base 2, and the lamp cover 4 further includes a bowl-shaped concentration member 43 disposed on an end of the second tube part 22, and is open toward the cover plate 41 of the lamp cover 4. The concentration member 43 can be molded on the cover plate 41. As a result, the inner flow path 101 is defined cooperatively by the first tube part 21, the joint part 23, the second tube part 22, and the concentration member 43 in a coaxial manner. The second end 103 of the inner flow path 101 is defined by an end of the concentration member 43 connected to the cover plate 41 of the lamp cover 4. In this embodiment, ratio of the maximum inner diameter to the depth of the concentration member 43 is between 1.3 and 1.9. Such a ratio can result in a concentrated and smooth airflow.

As such, the circuit boards 31 are disposed on only the outer surfaces of the second tube part 22 and the joint part 23. Hence, the LEDs 32 are disposed on the circuit hoards 31 attached to the second tube part 22 and the joint part 23, so that some of the LEDs 32 emit light toward the distal end of the lamp cover 4, and each of the remaining LEDs 32 emits light in a radial direction of the second tube part 22. In this embodiment, the shapes of the shade bodies 42 are designed to compensate for light emitted away from the distal end of the lamp cover 4.

Another difference between this embodiment and the first preferred embodiment is that, the connector 27 of the base 2 further includes a second annular wall 273 extending from the inner periphery of the ring plate 271 toward the first tube part 21. To mount the driver 33, the first annular wall 272 of the connector 27 is sleeved on the lamp cap 5, in such a manner that the lamp cap 5 is disposed under the connector 27. Next, the whole driver 33 is inserted downwardly into the first and second annular walls 272, 273 of the connector 27, so that it is supported by the lamp cap 5. Afterwards, an insulation paste 6 is poured into spaces among the lamp cap 5, the first and second annular walls 272, 273 of the connector 27, and the driver 33, so as to protect and fix the driver 33 relative to the lamp cap 5 and the connector 27. Finally, the second annular wall 273 of the connector 27 is inserted into the first tube part 21 until the ring plate 271 comes into contact with the end of the first tube part 21 defining apertures 270 in the connector 27 are not sealed by the insulation paste 6. In this embodiment, the connector 27 has a larger space for fixing and protecting the driver 33.

Still another difference between this embodiment and the first embodiment resides in arrangement of the outer fins 26 of the base 2. In this embodiment, each set of outer fins 26 are radially arranged to facilitate easy flow of outer airflow between each adjacent pair of the outer fins 26 to thereby promote the heat-exchanging efficiency.

Figure 10:
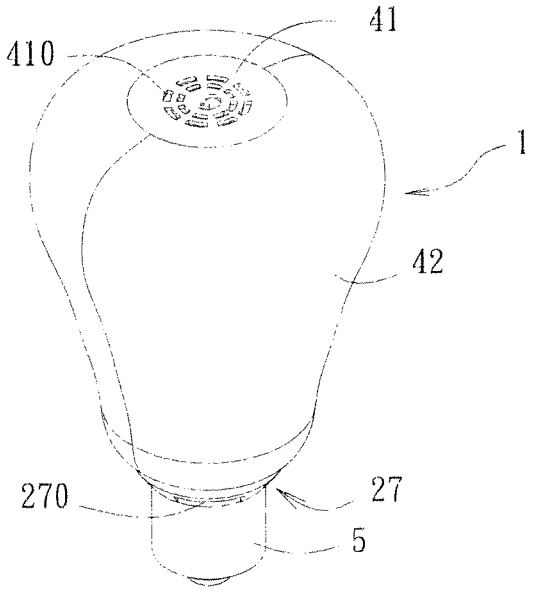
FIG. 10 is an assembled perspective view of the third preferred embodiment of a luminaire according to this invention.
Figure 12:
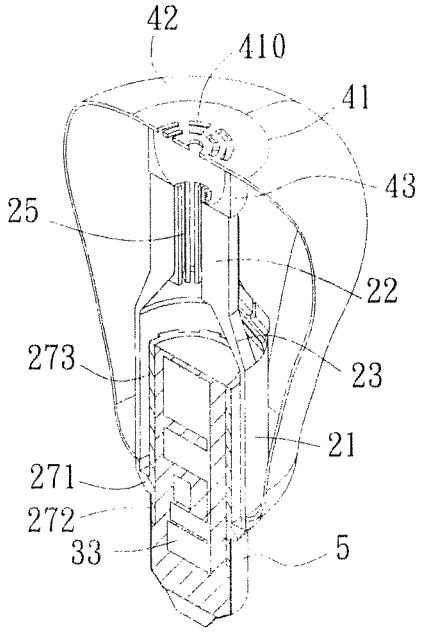
FIG. 12 is a perspective cutaway view of the third preferred embodiment.
Figure 11:
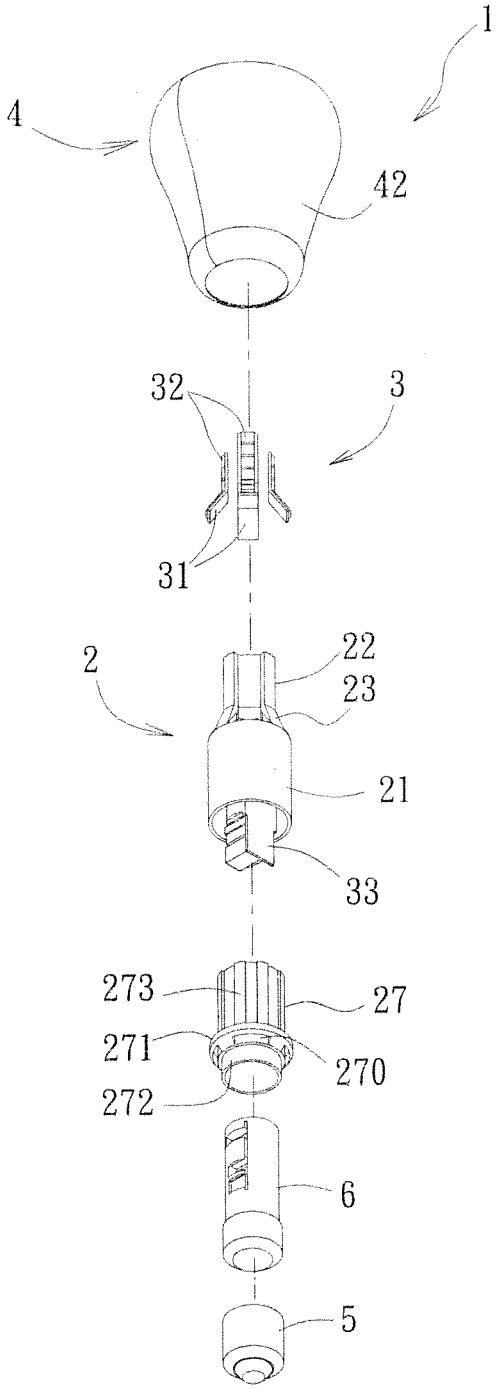
FIG. 11 is an exploded perspective view of the third preferred embodiment.

FIGS. 10, 11, and 12 show the third preferred embodiment of a luminaire 1 according to this invention, which is different from the second preferred embodiment in that, the outer fins 26 are omitted from the base 2, and the shade bodies 42 are adhered to each other. An assembly of the shade bodies 42 is secured to the cover plate 41 at one end thereof, and to an outer surface of the first tube part 22 or the connector 27 at the other end thereof.

In view of the above, through design of the inner flow path 101 and the outer flow path, heat exchange is carried out between an assembly of the inner and outer fins 25, 26 and air within the inner flow path 101 and the outer flow path, so as to dissipate heat into the surroundings by thermal convection. Furthermore, due to the streamline shaped structures of the outer fins 26, the length of the outer flow path is increased to promote the heat-exchanging efficiency. Further, the inner flow path 101 has a shrunk portion corresponding to the second tube part 22 to allow for an increase in the flow rate of the inner airflow within the second tube part 22, such that the cooling efficiency is promoted, thereby solving the problem of dissipating heat from the light-emitting unit 3.

With this invention thus explained, it is apparent that numerous modifications and variations can be made without departing from the scope and spirit of this invention. It is therefore intended that this invention be limited only as indicated by the appended claims.

We claim:

1. A luminaire comprising:

a base including a first tube part, a second tube part, a joint part connected between said first and second tube parts, a connector, and an inner flow path defined cooperatively to extend within said first tube part, said joint part, and said second tube part in a coaxial manner between opposite first and second ends, an inner diameter of said first tube part being different from that of said second tube part, said joint part being frustoconical and being coupled to said second tube part to define a Y-shaped contour such that said inner flow path is continuously enclosed along the Y-shaped contour from said first tube part to said second tube part, said connector being disposed at said first end of said inner flow path and being formed with at least one first aperture;

a light-emitting unit disposed on said outer surfaces of said second tube part and said joint part in such a manner to allow heat generated from said light-emitting unit to be transmitted onto said base and to emit light with different light emitting angles; and a lamp cover fixed on said base for covering said light-emitting unit, said lamp cover being formed with at least one second aperture;

wherein, when a temperature of said base is increased as a result of the heat, heat exchange occurs between said base and air in said inner flow path to form hot air in said inner flow path, so that the hot air flows out of said luminaire through one of said first and second apertures, and cold air is sucked into said luminaire through the other one of said first and second apertures, thereby creating an inner airflow.

2. The luminaire as claimed in claim 1, wherein said second tube part has an inner diameter smaller than that of said first tube part.

3. The luminaire as claimed in claim 2, wherein a cross-sectional area ratio of said first tube part to said second tube part is greater than 2.25.

4. The luminaire as claimed in claim 1, wherein: said base further includes a plurality of inner fins extending from an inner surface of at least one of said first tube part, said second tube part, and said joint part; and each of said first tube part, said second tube part, said joint part, and said inner fins is made of a thermally conducting material.

5. The luminaire as claimed in claim 1, wherein: said base further includes a plurality of outer fins disposed on outer surfaces of said second tube part, said joint part, and said first tube part; and each of said first tube part, said second tube part, said joint part, and said outer fins is made of a thermally conducting material.

6. The luminaire as claimed in claim 5, wherein said outer fins are divided into a plurality of radially arranged sets, each of which includes at least one of said outer fins.

7. The luminaire as claimed in claim 6, wherein each of said sets includes a plurality of said outer fins that are parallel to each other.

8. The luminaire as claimed in claim 6, wherein each of said sets includes a plurality of said outer fins that are radially arranged.

9. The luminaire as claimed in claim 1, wherein an end of said first tube part distal from said joint part defines said first end of said inner flow path.

10. The luminaire as claimed in claim 9, wherein said lamp cover has a distal end that is distal from a top portion of said base, and that is aligned with said second end of said inner flow path.

11. The luminaire as claimed in claim 10, wherein said base further includes an extending part having an open end that is open toward said distal end of said lamp cover and that defines said second end of said inner flow path, said lamp cover including a cover plate for covering said open end of said extending part, said second aperture being formed through said cover plate.

12. The luminaire as claimed in claim 11, wherein a ratio of a maximum inner diameter of said extending part to a depth of said extending part is between 1.3 and 1.9.

13. The luminaire as claimed in claim 9, wherein said lamp cover includes a concentration member disposed on an end of said second tube part and having an open end opening toward said lamp cover, and a cover plate for covering said open end of said concentration member, said second aperture being formed through said cover plate, said second end of said inner flow path being defined by said open end of said concentration member.

14. The luminaire as claimed in claim 13, wherein a ratio of a maximum inner diameter of said concentration member to a depth of said concentration member is between 1.3 and 1.9.

15. The luminaire as claimed in claim 1, wherein said light-emitting unit includes a plurality of circuit boards disposed on outer surfaces of said second tube part and said joint part, and a plurality of LEDs disposed on said circuit boards.

16. The luminaire as claimed in claim 15, wherein said base further includes an extending part connected to said second tube part and opening toward said distal end of said lamp cover, at least one of said circuit boards being disposed on an outer surface of said extending part.

17. The luminaire as claimed in claim 16, wherein said connector is mounted removably to aid first tube part, and includes a ring plate and an annular wall, at least one of said first apertures being formed in said ring plate, said annular wall extending from an inner periphery of said ring plate in a direction away from said first tube part.

18. The luminaire as claimed in claim 17, further comprising a lamp cap inserted into said annular wall and adapted for electrical connection with an external power supply.

19. The luminaire as claimed in claim 15, wherein said LEDs of said light-emitting unit disposed on said outer surface of said second tube part emit light at an angle different from that of said LEDs of said light-emitting unit disposed on said outer surface of said joint part.

* * * * *